US010410780B2

(12) United States Patent
Takashita et al.

(10) Patent No.: US 10,410,780 B2
(45) Date of Patent: Sep. 10, 2019

(54) IRON POWDER FOR DUST CORE

(71) Applicant: JFE STEEL CORPORATION, Chiyoda-ku, Tokyo (JP)

(72) Inventors: Takuya Takashita, Chiba (JP); Naomichi Nakamura, Chiba (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 213 days.

(21) Appl. No.: 14/764,273

(22) PCT Filed: Mar. 18, 2014

(86) PCT No.: PCT/JP2014/001559
§ 371 (c)(1),
(2) Date: Jul. 29, 2015

(87) PCT Pub. No.: WO2014/171065
PCT Pub. Date: Oct. 23, 2014

(65) Prior Publication Data

US 2015/0364236 A1 Dec. 17, 2015

(30) Foreign Application Priority Data

Apr. 19, 2013 (JP) ..... 2013-088720

(51) Int. Cl.

| | |
|---|---|
| ***H01F 3/08*** | (2006.01) |
| ***C22C 38/00*** | (2006.01) |
| ***H01F 1/24*** | (2006.01) |
| ***B22F 1/00*** | (2006.01) |
| ***H01F 1/147*** | (2006.01) |
| ***H01F 1/20*** | (2006.01) |

(52) U.S. Cl.
CPC ..... *H01F 3/08* (2013.01); *B22F 1/00* (2013.01); *B22F 1/0011* (2013.01); *C22C 38/00* (2013.01); *C22C 38/001* (2013.01); *C22C 38/004* (2013.01); *H01F 1/147* (2013.01); *H01F 1/20* (2013.01); *H01F 1/24* (2013.01); *C22C 2202/02* (2013.01)

(58) Field of Classification Search
CPC ..... B22F 2301/35; C22C 38/00; H01F 3/08
USPC ..... 420/128
See application file for complete search history.

(56) References Cited

U.S. PATENT DOCUMENTS

| | | | |
|---|---|---|---|
| 8,236,087 B2 | 8/2012 | Mitani et al. | |
| 2007/0203051 A1 | 8/2007 | Vidarsson et al. | |
| 2008/0231409 A1 | 9/2008 | Kugai et al. | |
| 2009/0226751 A1 | 9/2009 | Mitani et al. | |
| 2012/0048063 A1* | 3/2012 | Maetani | C22C 33/0271 75/246 |
| 2012/0164453 A1 | 6/2012 | Hojo et al. | |
| 2013/0269249 A1 | 10/2013 | Kawano et al. | |
| 2016/0303652 A1* | 10/2016 | Takashita | C22C 38/00 |

FOREIGN PATENT DOCUMENTS

| | | | |
|---|---|---|---|
| CN | 1914697 | A | 2/2007 |
| JP | H08-921 | B2 | 1/1996 |
| JP | 2005-187918 | A | 7/2005 |
| JP | 2005-248274 | A | 9/2005 |
| JP | 2006-024869 | A | 1/2006 |
| JP | 2006-283166 | A | 10/2006 |
| JP | 2007-092162 | A | 4/2007 |
| JP | 2008063652 | A | 3/2008 |
| JP | 2008-277775 | A | 11/2008 |
| JP | 2010-043361 | A | 2/2010 |
| JP | 4630251 | B2 | 2/2011 |
| JP | 2012-140679 | A | 7/2012 |
| WO | 2008/032707 | A1 | 3/2008 |
| WO | 2012029969 | A1 | 3/2012 |

OTHER PUBLICATIONS

May 5, 2016, Office Action issued by the State Intellectual Property Office in the corresponding Chinese Patent Application No. 201480022072.4 with English language Search Report.
Aug. 30, 2016, Office Action issued by the Korean Intellectual Property Office in the corresponding Korean Patent Application No. 10-2015-7025638 with English language statement of relevance.
Jun. 17, 2014 International Search Report issued in International Patent Application No. PCT/JP2014/001559.
Sep. 29, 2015, Office Action issued by the Japan Patent Office in the corresponding Japanese Patent Application No. 2013-088720.
Jan. 5, 2018, Office Action issued by the United States Patent and Trademark Office in the U.S. Appl. No. 14/442,217.

* cited by examiner

*Primary Examiner* — Weiping Zhu
(74) *Attorney, Agent, or Firm* — Kenja IP Law PC

(57) ABSTRACT

An iron powder for dust cores has an apparent density is 3.8 g/cm$^3$ or more, a mean particle size (D50) is 80 μm or more, 60% or more of powder with a powder particle size of 100 μm or more has a mean grain size of 80 μm or more inside the powder particle, an area ratio of inclusions to a matrix phase of the powder is 0.4% or less, and a micro Vickers hardness (testing force: 0.245 N) of a powder cross-section is 90 Hv or less. It is thus possible to obtain iron powder for dust cores in order to manufacture a dust core that has low hysteresis loss even after the iron powder is formed and subjected to strain relief annealing.

2 Claims, No Drawings

IRON POWDER FOR DUST CORE

TECHNICAL FIELD

This disclosure relates to iron powder for dust cores in order to manufacture a dust core that has a coarse grain size and low hysteresis loss even after formation and strain relief annealing.

BACKGROUND

Magnetic cores used in motors, transformers, and the like are required to have high magnetic flux density and low iron loss. Conventionally, electrical steel sheets have been stacked in such magnetic cores, yet in recent years, dust cores have attracted attention as magnetic core material for motors.

The most notable characteristic of a dust core is that a 3D magnetic circuit can be formed. Since electrical steel sheets are stacked to form a magnetic core, the degree of freedom for the shape is limited. A dust core, on the other hand, is formed by pressing soft magnetic particles coated with insulation coating. Therefore, all that is needed is a die in order to obtain a greater degree of freedom for the shape than with electrical steel sheets.

Press forming is also a shorter process than stacking steel sheets and is less expensive. Combined with the low cost of the base powder, dust cores achieve excellent cost performance. Furthermore, since the surfaces of the electrical steel sheets are insulated, the magnetic properties of the electrical steel sheet in the direction parallel to the steel sheet surface and the direction perpendicular to the surface differ, causing the magnetic cores consisting of stacked electrical steel sheets to have the defect of poor magnetic properties in the direction perpendicular to the surface. By contrast, in a dust core, each particle is coated with insulation coating, yielding uniform magnetic properties in every direction. A dust core is therefore appropriate for use in a 3D magnetic circuit.

Dust cores are thus indispensable material for designing 3D magnetic circuits, and due to their excellent cost performance, they have also been used in recent years from the perspectives of reducing the size of motors, reducing use of rare earth elements, reducing costs, and the like. Research and development of motors with 3D magnetic circuits has thus flourished.

When manufacturing high-performance magnetic components using such powder metallurgy techniques, there is a demand for components to have excellent iron loss properties after formation (low hysteresis loss and low eddy current loss).

In response to this demand, JP 4630251 B2 (PTL 1) and WO08/032707 (PTL 2) disclose techniques for improving magnetic properties as follows. Iron-based powder is adjusted so that upon sieve classification with a sieve having an opening of 425 μm, the iron-based powder that does not pass through the sieve constitutes 10 mass % or less, and upon sieve classification with a sieve having an opening of 75 μm, the iron-based powder that does not pass through the sieve constitutes 80 mass % or more, and so that upon inspecting at least 50 iron-based powder cross-sections, measuring the grain size of each iron-based powder, and calculating the grain size distribution including at least the maximum grain size, crystal grains with a grain size of 50 μm or more constitute 70% or more of the measured crystal grains.

JP H08-921 B (PTL 3) discloses a technique related to pure iron powder for powder metallurgy with excellent compressibility and magnetic properties. The impurity content of the iron powder is C≤0.005%, Si≤0.010%, Mn≤0.050%, P≤0.010%, S≤0.010%, O≤0.10%, and N≤0.0020%, and the balance of the powder consists substantially of Fe and incidental impurities. The particle size distribution is, on the basis of weight percent by sieve classification using sieves prescribed in JIS Z 8801, constituted by 5% or less of particles of −60/+83 mesh, 4% or more to 10% or less of particles of −83/+100 mesh, 10% or more to 25% or less of particles of −100/+140 mesh, and 10% or more to 30% or less of particles passing through a sieve of 330 mesh. Crystal grains included in particles of −60/+200 mesh are coarse crystal grains with a mean grain size number (a smaller number indicating a larger grain size) of 6.0 or less measured by a ferrite grain size measuring method prescribed in JIS G 0052. When 0.75% of zinc stearate is blended as a lubricant for powder metallurgy and the result is compacted with a die at a compacting pressure of 5 t/cm$^2$, a green density of 7.05 g/cm$^3$ or more is obtained.

Furthermore, JP 2005-187918 A (PTL 4) discloses a technique related to insulation-coated iron powder for dust cores such that an insulating layer is formed on the surface of iron powder particles having a micro Vickers hardness Hv of 75 or less, and JP 2007-092162 A (PTL 5) discloses a technique related to high compressibility iron powder that includes by mass %, as impurities, C: 0.005% or less, Si: more than 0.01% to 0.03% or less, Mn: 0.03% or more to 0.07% or less, S: 0.01% or less, O: 0.10% or less, and N: 0.001% or less, wherein particles of the iron powder have a mean crystal grain number of 4 or less and a micro Vickers hardness Hv of 80 or less on average.

CITATION LIST

Patent Literature

PTL 1: JP 4630251 B
PTL 2: WO08/032707
PTL 3: JP H08-921 B
PTL 4: JP 2005-187918 A
PTL 5: JP 2007-092162 A

While a reduction in iron loss is considered in the techniques disclosed in PTL 1 and PTL 2, the value remains high at 40 W/kg for iron loss at 1.5 T and 200 Hz.

A reduction in iron loss is not sufficiently considered in the techniques disclosed in PTL 3 through PTL 5, and the reduction of iron loss has thus remained a problem.

It could therefore be helpful to provide iron powder for dust cores in order to manufacture a dust core that has low hysteresis loss even after the iron powder is formed and subjected to strain relief annealing.

SUMMARY

In the case of an iron core used at a relatively low frequency (3 kHz or less), such as a motor iron core, hysteresis loss accounts for the majority of iron loss. Nevertheless, the hysteresis loss of a dust core is extremely high as compared to a stacked steel sheet. In other words, in order to reduce iron loss of a dust core, reduction of hysteresis loss becomes extremely important.

Upon carefully examining hysteresis loss in dust cores, we discovered that hysteresis loss in dust cores has a particularly strong correlation with the inverse of the grain size of the green compact, and that when the inverse of the grain size is small, i.e. in the case of coarse crystal grains, low hysteresis loss is obtained.

Furthermore, in order to obtain a dust core with coarse crystal grains, we discovered that the following factors are important:

(I) a coarse particle size and grain size in the original powder, (II) no unnecessary strain in the powder, (III) strain not accumulating easily upon formation, and (IV) nothing to impede growth of crystal grains in the powder at the time of strain relief annealing.

Our iron powder for dust cores is based on these discoveries.

We thus provide:

1. An iron powder for dust cores comprising iron as a principal component, wherein the iron powder has an apparent density of 3.8 g/cm$^3$ or more and a mean particle size (D50) of 80 μm or more, 60% or more of powder with a powder particle size of 100 μm or more has a mean grain size of 80 μm or more inside the powder particle, an area ratio of an inclusion within an area of a matrix phase of the powder is 0.4% or less, and a micro Vickers hardness (testing force: 0.245 N) of a powder cross-section is 90 Hv or less.

2. The iron powder for dust cores of 1., wherein 70% or more of the powder with the powder particle size of 100 μm or more has the mean grain size of 80 μm or more inside the powder particle.

It is thus possible to obtain iron powder for dust cores in order to manufacture a dust core that has a coarse grain size and low hysteresis loss even after the iron powder is formed and subjected to strain relief annealing.

DETAILED DESCRIPTION

Our iron powder for dust cores will now be described in detail.

The reasons for the numerical limitations on our iron powder are described. Iron is used as the principal component in our powder, and such a powder with iron as the principal component refers to including 50 mass % or more of iron. Other components may be included as per the chemical composition and ratios used in conventional iron powder for dust cores.

(Apparent Density)

Iron powder undergoes plastic deformation by press forming to become a high-density green compact. We discovered that as the amount of plastic deformation is smaller, the crystal grains after strain relief annealing become coarser.

In other words, in order to reduce the amount of plastic deformation of the powder at the time of forming, the filling rate of the powder into the die needs to be increased. We discovered that to do so, the apparent density of the powder needs to be 3.8 g/cm$^3$ or more, preferably 4.0 g/cm$^3$ or more.

The reason is that if the apparent density falls below 3.8 g/cm$^3$, a large amount of strain is introduced into the powder at the time of formation, and the crystal grains after formation and strain relief annealing end up being refined. No upper limit is placed on the apparent density of the powder, yet in industrial terms the upper limit is approximately 5.0 g/cm$^3$.

The apparent density is an index indicating the degree of the filling rate of the powder and can be measured with the experimental method prescribed in JIS Z 2504.

(Mean Particle Size: D50)

The upper limit on the grain size of the green compact is the particle size of the base power. The reason is that in the case of a dust core, the particle surface is covered by an insulating layer, and the crystal grain cannot grow coarser beyond the insulating layer. Therefore, the mean particle size of the powder should be as large as possible, such as 80 μm or more and preferably 90 μm or more. No upper limit is placed on the mean particle size of the powder, yet the upper limit may be approximately 425 μm.

In this disclosure, the mean particle size refers to the median size D50 of a weight cumulative distribution and is assessed by measuring the particle size distribution using sieves prescribed in JIS Z 8801-1.

(Grain Size within Particles Having a Particle Size of 100 μm or More)

At the time of plastic deformation, high strain easily accumulates at crystal grain boundaries, which easily become nuclei-generating sites of recrystallized grains. In particular, powder with a large powder particle size easily undergoes plastic deformation at the time of formation, and strain easily accumulates. Therefore, in powder with a powder particle size of 100 μm or more, there should be few crystal grain boundaries in the powder state. Specifically, 60% or more of powder with a powder particle size of 100 μm or more needs to have a mean grain size of 80 μm or more inside the powder particle when the mean grain size measured by powder cross-section observation. The ratio of powder for which the mean grain size is 80 μm or more is preferably 70% or more.

The grain size of our powder may be calculated with the following method.

First, the iron powder to be measured is mixed into thermoplastic resin powder. The resulting mixed powder is then injected into an appropriate mold and heated to melt the resin. The result is cooled and hardened to yield a resin solid that contains iron powder.

An appropriate cross-section of this resin solid that contains iron powder is cut, and the resulting face is polished and treated by corrosion. Using an optical microscope or a scanning electron microscope (100× magnification), the cross-sectional microstructure of the iron powder particles is then observed and imaged. Image processing is then performed on the captured image, and the area of the particles is calculated. Commercially available image analysis software, such as Image J, may be used for image analysis.

From the area of the particles, the particle sizes under spherical approximation are calculated, and particles with a particle size of 100 μm or more are distinguished. Next, for particles with a particle size of 100 μm or more, the particle area is divided by the number of crystal grains in the particle to calculate the crystal grain area. The size calculated by spherical approximation from this crystal grain area is then taken as the grain size.

We performed this operation in at least four fields on 10 or more particles with a particle size of 100 μm or more to calculate the abundance ratio (%) of particles with a grain size of 80 μm or more in the powder. In other words, calculating the abundance ratio (%) allows for calculation of the ratio (%) of powder that, among powder with a particle size of 100 μm or more, has a mean grain size of 80 μm or more inside the powder.

(Area Ratio of Inclusions)

When present in the powder, inclusions become a pinning site at the time of recrystallization and thus are not preferable for suppressing grain growth. Furthermore, inclusions themselves become nuclei-generating sites of recrystallized grains and refine the crystal grain after formation and strain relief annealing. Inclusions themselves also cause an increase in hysteresis loss. Therefore, there are preferably few inclusions, and when observing a powder cross-section, the area ratio of inclusions should be 0.4% or less of the area of the matrix phase of the powder, preferably 0.2% or less.

The lower limit is not restricted and may be 0%. The area of the matrix phase of the powder refers to the phase occupying 50% or more of the powder cross-sectional area when observing a cross-section of a certain powder. For example, in the case of pure iron powder, the matrix phase refers to the ferrite phase in the powder cross-section. In the case of pure iron powder, the matrix phase is the result of subtracting the area of voids within the grain boundary of the powder from the area surrounded by the grain boundary of the powder.

Oxides including one or more of Mg, Al, Si, Ca, Mn, Cr, Ti, Fe, and the like are possible inclusions. The area ratio of inclusions may be calculated with the following method.

First, the iron powder to be measured is mixed into thermoplastic resin powder. The resulting mixed powder is then injected into an appropriate mold and heated to melt the resin. The result is cooled and hardened to yield a resin solid that contains iron powder. An appropriate cross-section of this resin solid that contains iron powder is cut, and the resulting face is polished and treated by corrosion. Using a scanning electron microscope (1000× to 5000× magnification), the cross-sectional microstructure of the iron powder particles is then observed and imaged as a backscattered electron image. In the captured image, inclusions appear with dark contrast. Therefore, the area ratio of inclusions can be calculated by applying image processing. We performed this process in any five or more fields chosen from the entire amount of iron powder that is being measured and then used the mean area ratio of inclusions in each field.

(Micro Vickers Hardness of Powder Cross-Section)

If strain accumulates inside the powder from before formation, then even if the above-described powder adjustment is performed, the crystal grains end up being refined, after formation and strain relief annealing, to the extent of the accumulated strain. Accordingly, the strain in the powder should be reduced insofar as possible.

For manufacturing reasons, however, atomized iron powder is subjected to reduction annealing in order to reduce the oxygen content, after which the iron powder needs to be mechanically crushed. Therefore, strain accumulates in the powder.

As described above, we discovered a correlation between strain in powder and hardness of the powder. As the hardness is lower, there is less strain.

Therefore, in our powder, the amount of strain is evaluated by micro Vickers hardness. Specifically, the hardness of the iron powder cross-section is set to be 90 Hv or less. The reason is that if the hardness of the powder exceeds 90 Hv, the crystal grains are refined after formation and strain relief annealing, thereby increasing hysteresis loss. The hardness is preferably 80 Hv or less.

The micro Vickers hardness can be measured with the following method.

First, the iron powder to be measured is mixed into thermoplastic resin powder. The resulting mixed powder is then injected into an appropriate mold and heated to melt the resin. The result is cooled and hardened to yield a resin solid that contains iron powder. An appropriate cross-section of this resin solid that contains iron powder is cut, and the resulting face is polished. After removing this polished, treated layer by corrosion, the hardness is measured using a micro Vickers hardness gauge (test force: 0.245 N (25 gf)) in accordance with JIS Z 2244. With one measurement point per particle, the hardness of at least ten particles of powder is measured, with the mean then being taken.

Next, a representative method of manufacturing to obtain our product is described. Of course, a method other than the one described below may be used to obtain our product.

Our powder, which has iron as the principal component, is preferably manufactured using an atomizing method. The reason is that powder obtained by an oxide reduction method or electrolytic deposition has a low apparent density, and a sufficient apparent density might not be obtained even if processing such as additional crushing is performed to increase the apparent density.

The atomizing method may be of any type, such as gas, water, gas and water, centrifugation, or the like. In practical terms, however, it is preferable to use an inexpensive water atomizing method or a gas atomizing method, which is more expensive than a water atomizing method yet which allows for relative mass production. As a representative example, the following describes a method of manufacturing when using a water atomizing method.

It suffices for the chemical composition of molten steel being atomized to have iron as the principal component. However, since a large quantity of oxide-based inclusions might be generated at the time of atomizing, the content of oxidizable metal elements (Al, Si, Mn, Cr, and the like) is preferably low. The following contents are preferable: Al≤0.01 mass %, Si≤0.03 mass %, Mn≤0.1 mass %, and Cr≤0.05 mass %. Of course, the content of oxidizable metal elements other than those listed above is also preferably reduced insofar as possible.

The atomized powder is then subjected to decarburization and reduction annealing. The annealing is preferably high-load treatment performed in a reductive atmosphere including hydrogen. For example, one or multiple stages of heat treatment is preferably performed in a reductive atmosphere including hydrogen, at a temperature of 700° C. or more to less than 1200° C., preferably 900° C. or more to less than 1100° C., with a holding time of 1 h to 7 h, preferably 2 h to 5 h. The grain size in the powder is thus coarsened. The dew point in the atmosphere is not limited and may be set in accordance with the C content included in the atomized powder.

After reduction annealing, the powder is subject to the first crushing. The apparent density is thus set to 3.8 g/cm$^3$ or more. After the first crushing, annealing is performed in hydrogen at 600° C. to 850° C. to remove strain in the iron powder. The reason for performing the annealing at 600° C. to 850° C. is in order to set the micro Vickers hardness of the powder cross-section to 90 Hv or less. After strain removal, the powder is crushed, avoiding the application of strain insofar as possible. After crushing, the particle size distribution is adjusted by sieve classification using sieves prescribed in JIS Z 8801-1 so that the apparent density and mean particle size fall within the ranges of our powder.

Furthermore, an insulation coating is applied to the above-described iron powder, which is then formed into a dust core.

The insulation coating applied to the powder may be any coating capable of maintaining insulation between particles. Examples of such an insulation coating include silicone resin; a vitreous insulating amorphous layer with metal phosphate or metal borate as a base; a metal oxide such as MgO, forsterite, talc, or $Al_2O_3$; or a crystalline insulating layer with $SiO_2$ as a base.

After applying an insulation coating to the particle surface with such a method, the resulting iron-based powder is injected in a die and pressure formed to a shape with desired dimensions (dust core shape) to yield a dust core. The pressure formation method may be any regular formation method, such as cold molding, die lubrication molding, or the like. The compacting pressure may be determined in accordance with use. If the compacting pressure is increased, however, the green density increases. Hence, a compacting pressure of 10 t/cm$^2$ (981 MN/m$^2$) or more is preferable, with 15 t/cm$^2$ (1471 MN/m$^2$) or more being more preferable.

At the time of the above-described pressure formation, as necessary, a lubricant may be applied to the die walls or added to the powder. At the time of pressure formation, the friction between the die and the powder can thus be reduced, thereby suppressing a reduction in the green density. Furthermore, the friction upon removal from the die can also be reduced, effectively preventing cracks in the green compact (dust core) at the time of removal. Preferable lubricants in this case include metallic soaps such as lithium stearate, zinc stearate, and calcium stearate, and waxes such as fatty acid amide.

The dust core thus formed is subjected, after pressure formation, to heat treatment in order to reduce hysteresis loss via strain relief and to increase the green compact strength. The heat treatment time of this heat treatment is preferably approximately 5 min to 120 min. Any of the following may be used without any problem as the heating atmosphere: the regular atmosphere, an inert atmosphere, a reductive atmosphere, or a vacuum. The atmospheric dew point may be determined appropriately in accordance with use. Furthermore, when raising or lowering the temperature during heat treatment, a stage at which the temperature is maintained constant may be provided.

EXAMPLES

Example 1

The iron powders used in this Example are 10 types of atomized pure iron powder with different values for the apparent density, D50, grain size, amount of inclusions, and micro Vickers hardness.

The iron powders with an apparent density of 3.8 g/cm$^3$ or more were gas atomized iron powders, and the iron powder with an apparent density of less than 3.8 g/cm$^3$ was water atomized iron powder. In either case, the composition of each iron powder was C<0.005 mass %, O<0.10 mass %, N<0.002 mass %, Si<0.025 mass %, P<0.02 mass %, and S<0.002 mass %.

An insulation coating was applied to these powders using silicone resin. The silicone resin was dissolved in toluene to produce a resin dilute solution such that the resin component is 0.9 mass %. The powder and the resin dilute solution were then mixed so that the rate of addition of the resin with respect to the powder became 0.15 mass %. The result was then dried in the atmosphere. After drying, a resin baking process was performed in the atmosphere at 200° C. for 120 min to yield coated iron-based soft magnetic powders. These powders were then formed using die lubrication at a compacting pressure of 15 t/cm$^2$ (1471 MN/m$^2$) to produce ring-shaped test pieces with an outer diameter of 38 mm, an inner diameter of 25 mm, and a height of 6 mm.

The test pieces thus produced were subjected to heat treatment in nitrogen at 650° C. for 45 min to yield samples. Winding was then performed (primary winding: 100 turns; secondary winding: 40 turns), and hysteresis loss measurement with a DC magnetizing device (1.5 T, DC magnetizing measurement device produced by METRON, Inc.) and iron loss measurement with an iron loss measurement device (1.5 T, 200 Hz, model 5060A produced by Agilent Technologies) were performed.

The samples after iron loss measurement were dissected, and the grain size was measured. Since dissected samples maintain the grain size in a green compact cross-section, the grain size in a green compact cross-section was measured with the following method.

First, the green compact (sample) to be measured was cut into pieces of an appropriate size (for example, 1 cm square), mixed with thermoplastic resin, injected into an appropriate mold, and heated to melt the resin. The result was cooled and hardened to yield a resin solid containing green compact.

Next, the resin solid containing green compact was cut so that the observation cross-section was perpendicular to the circumferential direction of the ring green compact, and the cut face was polished and treated by corrosion. Using an optical microscope or a scanning electron microscope (200× magnification), the cross-sectional microstructure was then imaged. In the captured image, five vertical lines and five horizontal lines were drawn, and the number of crystal grains traversed by the lines was counted. The grain size was calculated by dividing by the entire length of the five vertical

TABLE 1

| No. of iron powder | Apparent density (g/cm$^3$) | D50 (μm) | Ratio of powder with a grain size of 80 μm or more among powder with a particle size of 100 μm or more (%) | Inclusions (%) | Micro Vickers hardness (Hv) | Notes |
|---|---|---|---|---|---|---|
| 1 | 4.3 | 98.6 | 100 | 0.38 | 85 | Example |
| 2 | 4.2 | 102.4 | 86.2 | 0.24 | 80 | Example |
| 3 | 4.3 | 98.6 | 62.0 | 0.26 | 82 | Example |
| 4 | 4.2 | 102.2 | 65.0 | 0.21 | 83 | Example |
| 5 | 4.4 | 104.5 | 70.8 | 0.18 | 78 | Example |
| 6 | 4.4 | 106.4 | 95.0 | 0.39 | 100 | Comparative Example |
| 7 | 4.1 | 89.0 | 45.0 | 0.37 | 87 | Comparative Example |
| 8 | 3.2 | 95.0 | 62.0 | 0.26 | 76 | Comparative Example |
| 9 | 3.8 | 75.5 | 60.1 | 0.37 | 85 | Comparative Example |
| 10 | 3.9 | 160.0 | 100 | 0.57 | 84 | Comparative Example |

and five horizontal lines by the number of crystal grains traversed. In the case of a line traversing a void, the traversed length of the void was subtracted from the total length.

This measurement was performed in four fields for each sample, and the mean was calculated and used.

Table 2 lists the results of measuring the crystal grains.

TABLE 2

| No. of green compact sample | No. of iron powder used | Green compact grain size (μm) | Notes |
|---|---|---|---|
| 1 | 1 | 27.0 | Example |
| 2 | 2 | 29.7 | Example |
| 3 | 3 | 28.7 | Example |
| 4 | 4 | 27.9 | Example |
| 5 | 5 | 33.6 | Example |
| 6 | 6 | 19.9 | Comparative Example |
| 7 | 7 | 21.2 | Comparative Example |
| 8 | 8 | 12.1 | Comparative Example |
| 9 | 9 | 17.7 | Comparative Example |
| 10 | 10 | 19.0 | Comparative Example |

Table 2 shows that the largest grain size in the Comparative Examples was 21.2 μm, whereas in the Examples, the smallest grain size was 27.0 μm, and the largest was 33.6 μm.

Table 3 lists the measurement results obtained by performing magnetic measurements on the samples. The acceptance criterion for iron loss in the Examples was set to 30 W/kg or less, an even lower value than the acceptance criterion for the Examples disclosed in PTL 1 (40 W/kg or less).

TABLE 3

| Sample No. | No. of iron powder used | Hysteresis loss (W/kg) | Eddy current loss (W/kg) | Iron loss (W/kg) | Notes |
|---|---|---|---|---|---|
| 1 | 1 | 23.1 | 3.7 | 26.8 | Example |
| 2 | 2 | 20.6 | 3.8 | 24.4 | Example |
| 3 | 3 | 21.1 | 3.8 | 24.9 | Example |

TABLE 3-continued

| Sample No. | No. of iron powder used | Hysteresis loss (W/kg) | Eddy current loss (W/kg) | Iron loss (W/kg) | Notes |
|---|---|---|---|---|---|
| 4 | 4 | 20.2 | 3.9 | 24.1 | Example |
| 5 | 5 | 19.6 | 4.2 | 23.8 | Example |
| 6 | 6 | 27.1 | 4.9 | 32.0 | Comparative Example |
| 7 | 7 | 27.1 | 3.1 | 30.2 | Comparative Example |
| 8 | 8 | 31.2 | unmeas-urable | unmeas-urable | Comparative Example |
| 9 | 9 | 28.4 | 2.6 | 31.0 | Comparative Example |
| 10 | 10 | 32.3 | 7.0 | 39.3 | Comparative Example |

Table 3 shows that as compared to the Comparative Examples, the hysteresis loss was kept lower in all of the Examples, thereby keeping the iron loss low and satisfying the acceptance criterion for iron loss in all of the above Examples.

It is also clear that for both the Examples and the Comparative Examples, every sample with an apparent density of 3.8 g/cm$^3$ or more had an eddy current loss of less than 10 W/kg. This shows that by only covering with silicone resin, the insulation between particles was maintained even after strain relief annealing at 650° C., and that the increase in apparent density was effective for reducing both hysteresis loss and eddy current loss.

The invention claimed is:

1. An iron powder for dust cores comprising iron as a principal component, wherein the iron powder has an apparent density of 3.8 g/cm$^3$ or more and 5.0 g/cm$^3$ or less and a mean particle size (D50 of a weight cumulative distribution) of 98.6 μm or more, 60% or more of powder with a powder particle size of 100 μm or more has a mean grain size of 80 μm or more inside the powder particle, an area ratio of an inclusion to a matrix phase of the powder is 0.4% or less, and a micro Vickers hardness (testing force: 0.245 N) of a powder cross-section is 90 Hv or less.

2. The iron powder for dust cores of claim 1, wherein 70% or more of the powder with the powder particle size of 100 μm or more has the mean grain size of 80 μm or more inside the powder particle.

* * * * *